United States Patent [19]

Beisler

[11] 4,281,606

[45] Aug. 4, 1981

[54] SEWING MACHINE

[75] Inventor: Alfons Beisler, Goldbach, Fed. Rep. of Germany

[73] Assignee: Beisler GmbH, Fed. Rep. of Germany

[21] Appl. No.: 858,369

[22] Filed: Dec. 7, 1977

[30] Foreign Application Priority Data

Dec. 15, 1976 [DE] Fed. Rep. of Germany ..... 2656720

[51] Int. Cl.[2] ..... D05B 21/00

[52] U.S. Cl. ..... 112/121.15; 112/311

[58] Field of Search ..... 112/121.15, 121.29, 112/121.11, 121.12, 65, 70, 207

[56] References Cited

U.S. PATENT DOCUMENTS

| | | | |
|---|---|---|---|
| 3,170,423 | 2/1965 | Henebry | 112/121.12 |
| 3,543,737 | 1/1970 | Maschmann | 112/121.12 |
| 3,871,309 | 3/1975 | Frost | 112/121.15 X |
| 4,044,698 | 8/1977 | Conner, Jr. | 112/121.12 |

*Primary Examiner*—H. Hampton Hunter

*Attorney, Agent, or Firm*—Gifford, VanOphem, Sheridan & Sprinkle

[57] ABSTRACT

A sewing machine incorporates a device for transferring a flap to be sewed from a receiving station to a sewing station, the device comprising a clamp with powered jaws, which device can be moved pivotally between the receiving and sewing stations.

2 Claims, 7 Drawing Figures

SEWING MACHINE

FIELD OF THE INVENTION

This invention relates to a sewing machine having a device for transferring flaps to a sewing station.

OBJECT OF THE INVENTION

An object of the invention is to provide a sewing machine having a simple device which is inexpensive to produce and which makes it possible, during the sewing of a pocket or like flap to a garment part, to align to the correct position a next flap to be sewn on and, after the sewing-on of one flap, to convey the flap mechanically from the receiving station to the sewing station. The intention is to make it possible to be able to sew, in a contemplated period of time, considerably more flaps than has previously been possible.

BRIEF STATEMENT OF THE INVENTION

The invention provides a sewing machine having a device for transferring a flap from a receiving station to the sewing station, and including a controllable clamp, which has an openable and closable jaw and which is mounted for swinging movement on a stationary carrier of the sewing machine. The device is designed so as to be placeable into a receiving position and a transfer position, an extraneous force accomplishing the adjustment of the clamping clasp and to the actuating of its jaw.

The invention makes it possible, during the sewing-on of one flap, to align in the correct position a further flap at the receiving station, and to control the clamp in such a way that it clamps this next flap with its jaw, so that it can transfer it to the sewing position immediately the preceding flap has been sewn on.

At the receiving station, for the aligning support of the flap in the hand-over position, a plate which is inclined in a desk-like manner and which has a stop which ensures the free overlap of the flap is mounted stationarily on the sewing machine. In this respect, it is advantageous if the plate is rectangular and plane-parallel in the sense that two of its edges extend parallel to the sewing table. In addition, it is advisable if the stop is designed as a ledge or strip which projects upwardly above the plate and extends parallel to the upper longitudinal edge thereof.

To form the openable jaw, it is advantageous if the clamp has a beam which is securely mounted on one side on an arm and a counter-beam which is hinged on one side to the same arm and which is connected to a lever. In this respect, it is advisable to make the design such that a hydraulic cylinder acts with its piston rod on the free end of the lever, the cylinder being connected to the arm which carries the beam. In addition to this, it is advantageous if the arm which carries the beam forms part of an angle lever which is hinged to the stationary carrier and on whose other arm a fluid cylinder, mounted on a stationary holder, acts with its piston rod.

It is advisable to dimension the angle lever in such a way and to mount it in such a way that the clamp is swingable between the receiving position and the transfer position. In the take-over position, the beam and the counter-beam, should be disposed above the upper edge of the desk-like plate in such a way that, with the jaw open, a flap lying aligned on the desk-like plate projects with its edge into the jaw and the beam and the counter-beam, on the way from the take-over position to the hand-over position, travelling through the space beneath the clamp in the open position thereof and on the way back, with the clamp closed, passing through the space above the clamp.

The invention makes it possible, while one flap is being sewn on to a piece of material, to align the next flap in the correct position on the receiving station and to grasp same at its edge by means of the jaw, so that, it can be brought, immediately after the flap previously subjected to the sewing procedure has been sewn on, automatically under the flap clamp and can be restrained by this on the upper side of the material clamp. A large part of that time, which has previously not been utilised can now be utilised, for the aligning insertion of the flap at the receiving station. Moreover, through the automatic transfer of the flap to the sewing station, the overall duration of time which was hitherto needed for the positionally-correct transfer of the flap into the sewing station can be considerably shortened.

DESCRIPTION OF A PREFERRED EMBODIMENT

Figure 1:
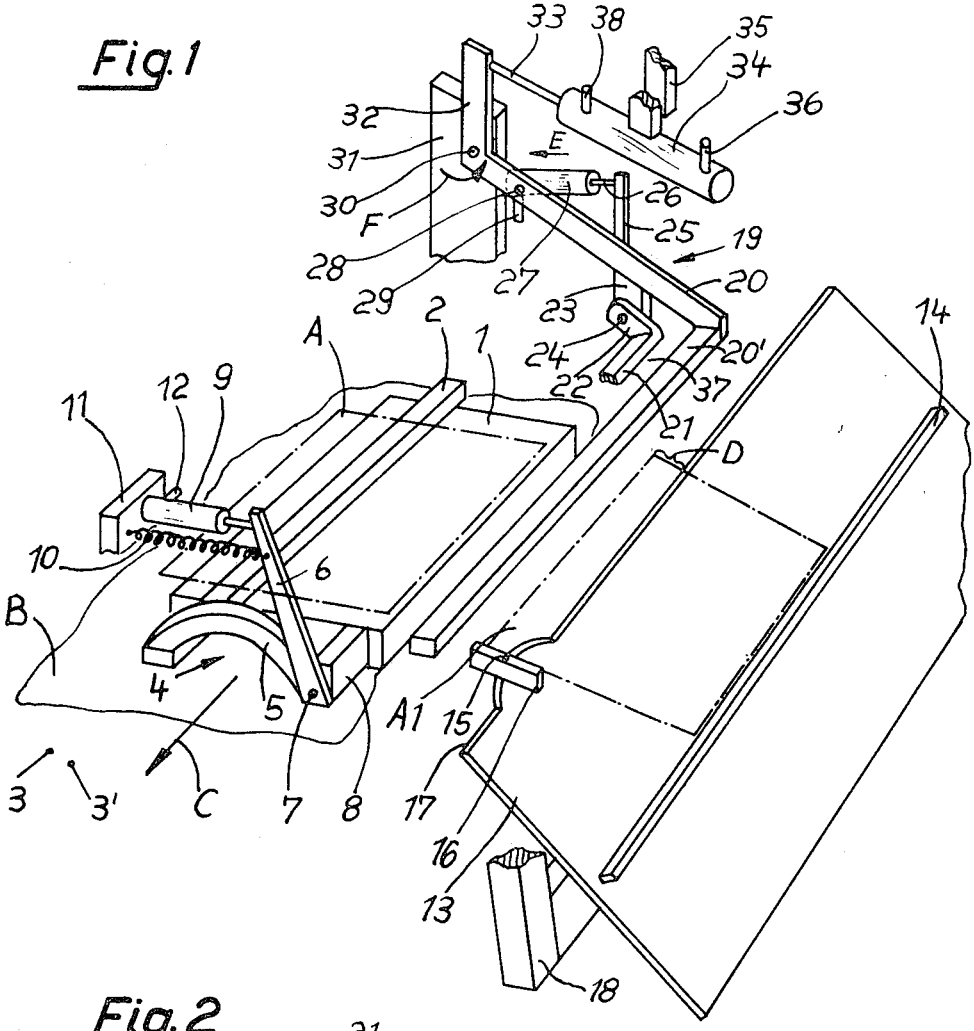
FIG. 1 is a perspective view of a preferred sewing machine of the invention, illustrating the essential parts of the device diagrammatically.

In a preferred sewing machine of the invention, a flap clamp 2 co-operates with a material clamp 1. It forces a flap A, indicated in dot-dash manner, onto the top of the material clamp 1 during the sewing of this flap A onto the material part B. For sewing, the material clamp 1 is shifted, together with flap clamp 2, in known manner in the direction of the arrow C to sewing needles 3, 3'.

The flap clamp 2 is hinged by means of an angle lever 4 having arms 5 and 6 mounted at 7 to a small support or guide block 8, which is connected securely to material clamp 1. A hydraulic cylinder 9 serves for opening flap clamp 2. Closure is effected by a draw spring 10. Serving for the mounting of the cylinder 9 is a retaining small support 11, which is securely connected (in a manner not shown) to material clamp 1. Pressure medium is fed to cylinder 9 through a connection 12 via a flexible line.

During the sewing of flap A on to material part B, a fresh flap A1 is in readiness for transfer to a position under flap clamp 2. An inclined plate 13 is provided with a stop ledge 14 fixed thereon and a stop toggle 16 which is swingably-mounted thereon at 15. The stop toggle conforms to the disposition of the flap. The flap A1 projects with its edge D above the upper edge 17 of plate 13, which plate 13 is stationarily fastened by means of a carrier 18 in a manner not shown, to the sewing machine.

For the transfer of the flap A1 from the plate 13 onto the top of the material clamp 1 and under the flap clamp 2, there is provided a clamp 19. This comprises the beam 20' which is fastened on one side to the arm 20 and with which the counter-beam 21, shown in broken-off manner, co-operates. It is approximately of the same length as the beam 20' and is mounted for swinging movement, via the arm 22 which emanates at a right angle from it and which is connected securely to it, on an adjointpiece 23 which emanates securely from the arm 20. Counter-beam 21 is pivoted to piece 2B which mounts a one-armed lever 25 which is driven by a piston rod 26 of a hydraulic cylinder 27 which is pivotally mounted at 28 to arm 20. The piston rod 26 is drawn by a spring in the interior of the cylinder 27 in the direction of the arrow E. Consequently, the clamp 19 is opened. When pressure medium is supplied via the connection 29 to the hydrocylinder 27, the piston rod 26 moves contra to the direction of the arrow E.Consequently the counter-beam 21 is swung in such a way that it comes to rest immediately opposite the beam 20'. An edge D of a flap, present for instance between the beam 20' and the counter-beam 21, and the clamp jaws are opened.

The arm 20 is part of an angle lever which is mounted for swinging movement at 30 on the carrier 31 connected stationarily to the sewing machine and on the other arm 32 of which there acts a piston rod 33 of a hydraulic cylinder 34, the cylinder of which is connected to a holder 35, which for its part is mounted stationarily on the sewing machine.

During the sewing-on of the flap A to the material part B, the seamstress prepares the transfer of the next flap to the sewing station. For this purpose, the seamstress gives a switching impulse, which brings about the feed of pressure medium via the connection 36 to the cylinder 34. Consequently, the clamp 19 with the jaw 37 open is swung about the hinge point 30 in the direction of the arrow F. Care must be taken to see that, in the deviated end position of the clamping clasp 19, the surface of the plate 13 comes to rest in alignment with the opened jaw 37 of the clamp 19. Now the flap A1 is placed, in the manner evident from FIG. 2, onto the plate 13. In this respect, the flap A1 extends with the edge D into the jaw 37. Then the seamstress gives an impulse, through which pressure medium is supplied via the connection 29 to the cylinder 27, so that the closing of the jaw 37 of the clamp 19 is effected. The flap A1 and the clamp 19 are initially held in this position.

During the sewing procedure, the material clamp 1 with the material part B and the flap A, which is held by the flap clamp 2 securely on the top of the material clamp 1, is shifted in the direction of the arrow C. By means of the sewing needles 3, 3', in this respect the flap A is sewn-on on the material part B. After the sewing procedure has been concluded, the automatic sewing mechanism causes the supply of pressure medium via the connection 12 of the cylinder 9. Consequently, the flap clamp 2 is opened. Now the material clamp 1 is adjusted, in known manner, in the opposite direction to the arrow C, into that position which it has to assume at the beginning of a sewing operation.

Figure 2:
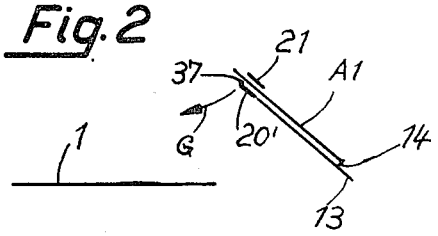
FIGS. 2 to 6 are representations in which the relative position of the essential components at various moments are reproduced schematically.
Figure 3:
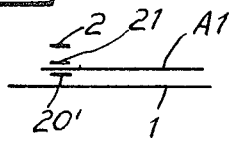
Figure 4:
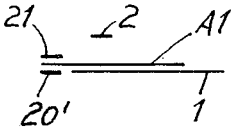
Figure 5:
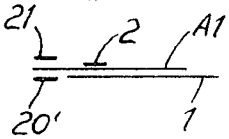
Figure 6:
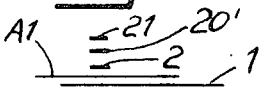

During the advance of the material clamp 1 in the direction of the arrow C, the seamstress has aligned a new material part B for the sewing-on of the following flap A1 on the sewing machine table. Consequently, the material clamp 1 comes to rest, upon the setting-back in the opposite direction to the arrow C, above the new material part B. The seamstress now causes, via the pedal switch which is not shown, the closing of the material clamp. Then the seamstress gives via the pedal switch a further impulse, which causes the feed of a piping (or edging or braid) in known manner, whereupon the automatic control mechanism brings about the supply of pressure medium to the cylinder 34 via the connection 38. Consequently, the closed clamp 19 with the new flap A1 is swung in the direction of the arrow G (FIG. 2). In this respect, the beam 20' and the counterbeam 21, with the restrained edge D of the flap A1, travel under the opened flap clamp 2 (FIG. 3) until the edge D projects to the left in the drawing beyond the material clamp 1 and the flap A1 comes moreover into bearing on the top of the material clamp 1. The clamp 19 now occupies its end position in the transfer position. Now the seamstress gives a further impulse, which brings about the fact that the hydrocylinder 9 is relieved via the connection 12, so that the spring 10 swings the arm 6 in the anticlockwise direction, whereby the flap clamp 2 is closed (FIG. 5). Then the cylinder 27 is automatically relieved via the connection 29. Consequently, the piston rod 26 is shifted, by the spring inside the cylinder 27, in the direction of the arrow E, whereby the jaw 37 of the clamp 19 is opened (FIG. 5). Now pressure medium is supplied via the connection 36 to the cylinder 34, so that the clamp 19 is swung about the hinge axis 30 in the direction of the arrow F (FIG. 1). In this respect, the beam 20' and the counter-beam 21 are, after passing through the space above the closed flap clamp 2 (FIG. 6), moved into the position shown in FIG. 2. The procedure is repeated.

The main feature of this invention lies in the cooperation of clamps 1 and 2 and clamp 19. Because flap clamp 2 and beam 20' and counter beam 21 are cantilevered from opposite sides of material clamp 1, they are able to pass one another. In operation, and with a material part B clamped by material clamp 1 against the table and with flap clamp 2 in position, and with arm 20 in its position, the entire assembly moves in the direction of arrow 'C' (FIG. 1) and the left hand edge of flap A is sewn to material part B.

Once the assembly has moved toward the needles, a portion of the table is exposed and it is at this portion that the operator arranges a new piece B. The operator then arranges a new flap A1 on table 13 and this is gripped by beam 20' and counter beam 21 with arm 20 being shown in its dotted position.

Once the sewing operation is completed, flap clamp 2 is raised to its dotted position, the united pieces A and B are removed, and plate 1 and clamp bar 2 and associated parts are moved in a direction counter to arrow C back to the initial position adjacent the new piece of fabric B. Plate 1 is then lowered to clamp the new base fabric B. Now arm 20 moves to its solid position, moving the new flap A1 to its desired position on top of plate 1.

Clamp bars 20' and 21 pass under clamp bar 2 (which is still in its dotted position). Arm 5 is then lowered to bring clamp part 2 to its solid position where it holds flap A1 firmly against plate 1. Clamp bars 20' and 21 then separate and bar 20 is returned to its dotted position. The left hand of flap A1 is momentarily raised and then dropped as bars 20' and 21 return, incidentally passing above clamp bar 2 so that a new sewing operation is now free to commence.

Figure 7:
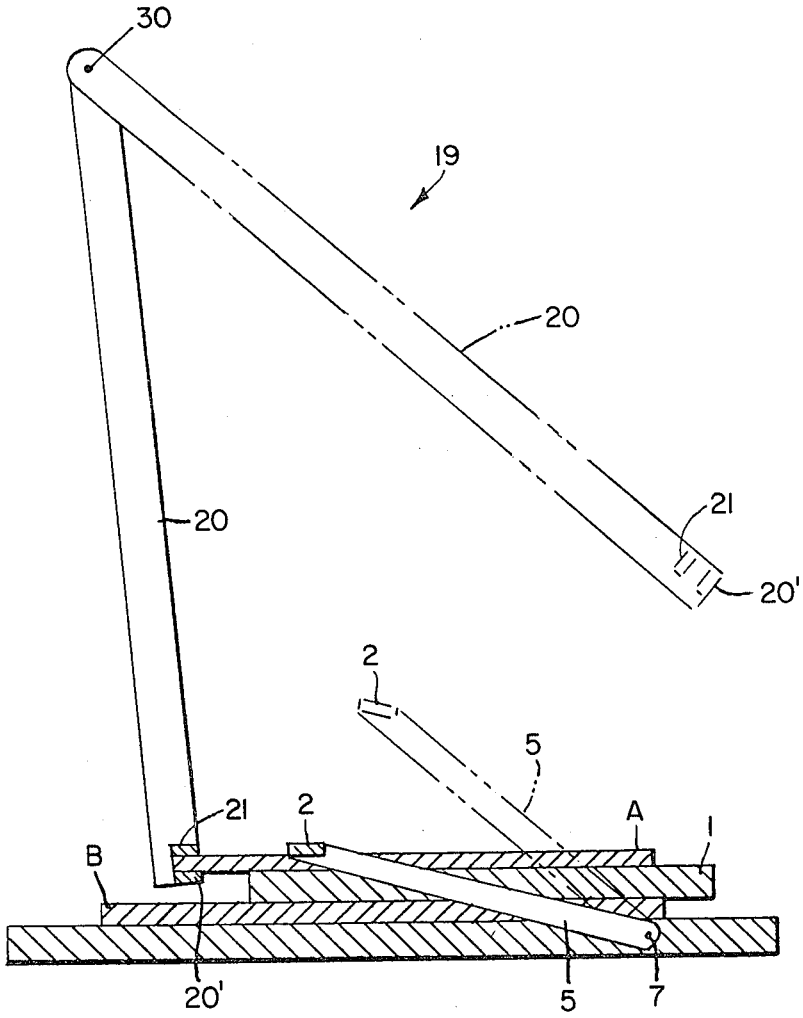
FIG. 7 is a schematic showing to represent machine operation.

In operation, referring specifically to FIG. 7, a panel A has been previously prepared in position on the support with one edge abutting the ledge 14, which serves to position it transversely and with one end abutting stop 16 so as to have an edge portion overlapping upper edge 14 of the support. (This step has been carried out during the sewing of a previous flap).

The main piece of material B is positioned on the table and clamped thereagainst by a slight downward movement of platform 1. Thereupon, clamp bar 2 is raised to the dotted position shown in FIG. 7, and clamp bars 21 and 20' are moved together to lie one above and one below the front edge portion of flap D and bar 21 is lowered so that the portion of flap A overlapping edge 17 is clamped therebetween. Next, arm 20 is pivoted about point 30 from its dotted position in FIG. 7 to its solid position. It will be appreciated that, during this movement, arms 21 and 20' pass underneath clamp bar 2. Then, with arms 21 and 20' stationary and locating flap A in its pre-determined position relative to cloth B, clamp bar 2 is lowered to clamp flap A against platform 1. Next clamp bar 21 is raised to release its hold on the front edge of flap A. During this movement, they raise and then release the edge portion of flap A which flips back to its determined position above cloth B. Later, bars 21, 20' move over clamp bar 2.

Now flap A and cloth B are securely fixed relative to each other and, together with the table, clamp bars and associated actuating mechanisms, are moved in the direction of arrow C and flap A is sewn to cloth B by means of needles 3,3'. When the sewing has been completed, clamp bar 2 is raised, platform 1 is raised, and the two united pieces are removed.

The whole assembly is then moved in a direction opposite to that of arrow C to bring it back to its starting position wherein a new main piece of cloth B can be positioned, a second flap A already having been positioned on the support during the sewing operation.

I claim:

1. In the feeding and clamping of a flap in a sewing machine having receiving and sewing stations and a bank of sewing needles, a pivotal mechanism mounted on the machine for achieving, during the sewing-on of a first flap to a garment part, a correct preliminary aligning of a second flap at the receiving station and a control of the clamping of the second flap followed by the mechanical transferring of the second flap from the receiving station to the sewing station for the next following sewing-on procedure comprising in combination:

a materials clamp 1, a flap clamp 2 cooperating with the material clamp, the material and flap clamps being shiftable in unison toward and away from the sewing needles, a guide block 8 secured to the material clamp 1, an angle lever 4 having a pair of arms 5 and 6 and being mounted on the guide block 8, the flap clamp 2 being hinged to the guide block 8 through the angle lever 4, a retaining support 11, a hydraulic cylinder 9 and cooperating piston mounted on the retaining support 11 for opening the flap clamp 2, spring means 10 for closing the flap clamp 2, an inclined plate 13 at the receiving station and fixedly mounted on the sewing machine for the aligning support of the flap in a hand-over position, a stop ledge 14 mounted on the inclined plate for ensuring the free overlap of the flap, a stop toggle 16 swingably mounted on the inclined plate 13, an openable jaw for transferring the flap from the inclined plate 13 onto the top of the material clamp 1 and under the flap clamp 2 and including:

(a) a carrier 31 fixed to the sewing machine, (b) an arm 20 swingably mounted on the carrier, (c) a beam 20' secured to the arm 20, (d) an arm 22, (e) a counter beam 21 secured to the arm 22, (f) a beam-mounted arm 23 pivotally supporting the counter-beam 21, (g) a one-armed actuatable lever 25, (h) a hydraulic cylinder 27 connected to the beam-mounted arm 23 and having a piston rod 26 connected to the actuatable lever 25, the beam-mounted arm 23 forming part of the angle lever 4 hinged to the carrier, the angle lever 4 being arranged for the swinging of the clamps between the receiving and transfer positions, with the beam and counter-beam being disposed above the upper edge of the inclined plate in the take-over position so that with the jaw opened a flap lying aligned on the inclined plate projects into the jaw and with the beam and counter-beam travelling on the way from the receiving to the transfer position, through the space underneath the clamp in the open position thereof and, on the way back travelling with the flap closed, and passing through the space above the flap clamp.

2. In the device as claimed in claim 1, with a stop toggle hinged to the plate and adapting itself to the course of the transverse side of the flap.

* * * * *